US005513838A

United States Patent [19]

Van Rossum

[11] Patent Number: 5,513,838

[45] Date of Patent: May 7, 1996

[54] CIRCLE CLAMP

[76] Inventor: Scott R. Van Rossum, 4982 N. Port Washington Rd., Glendale, Wis. 53217

[21] Appl. No.: 303,731

[22] Filed: Sep. 9, 1994

[51] Int. Cl.[6] ..... B25B 5/02

[52] U.S. Cl. ..... 269/203; 269/249; 269/258; 269/266; 269/287

[58] Field of Search ..... 269/203, 249, 269/258, 266, 287

[56] References Cited

U.S. PATENT DOCUMENTS

| | | | |
|---|---|---|---|
| 339,072 | 3/1886 | Niles | 269/249 |
| 2,073,314 | 3/1937 | Mihalyl | 269/287 |
| 2,366,350 | 1/1945 | Ostling | 269/258 |
| 2,627,113 | 2/1953 | Moray | 269/249 |
| 4,373,980 | 2/1983 | Skalmierski et al. | 269/287 |
| 4,828,241 | 5/1989 | Yang | 269/249 |
| 4,962,918 | 10/1990 | Yang | 269/208 |

*Primary Examiner*—Bruce M. Kisliuk
*Assistant Examiner*—Thomas W. Lynch
*Attorney, Agent, or Firm*—Nilles & Nilles

[57] ABSTRACT

A clamp is more versatile, less damaging, and able to apply a holding force directed from most any angle in its plane of action. This general work-holding clamp consists of several movable clamping units mounted on a circular frame. A clamping unit consists of a clamp screw, a small thumbscrew, and a base. The clamp screw serves its normal purpose, the thumbscrew holds the base in place on the frame, and the base connects the clamp screw to the frame. The circular frame carries all forces between the clamping units, and has a gap to improve versatility.

10 Claims, 1 Drawing Sheet

CIRCLE CLAMP

BACKGROUND OF THE INVENTION

This invention is a new work-holding device. It can often be quite difficult to hold various pieces of material together for further work or attachment. The use of a C-clamp or a similar device on objects requiring clamping pressure at angles other than 0–90–180 degrees usually requires so much pressure that the objects cannot be held together, or they are simply damaged by the excessive force.

Prior art clamps are disclosed, for example, in U.S. Pat. Nos. 2,803,208 to Bernard; 2,576,904 to Jessen and 2,336,350 to Ostling.

OBJECTS AND SUMMARY OF THE INVENTION

This new clamp will be more versatile, less damaging, and able to apply a holding force directed inward or outward from most any angle in or near its plane of action. This general work-holding clamp comprises several movable clamping units mounted on a circular frame. A clamping unit comprises a clamp screw, a small thumbscrew, and a base. The clamp screw serves its normal purpose, the thumbscrew holds the base in place on the frame, and the base connects the clamp screw to the frame. The circular frame carries all forces between the clamping units, and is shown with a gap that improves versatility. Whether the frame is a full circle, with any number of permanent or removable clamping units, or a partial circle as shown in the drawing, the materials of production would typically be of iron and steel although non-ferrous metals and non-metals can be used if desired.

DETAILED DESCRIPTION OF THE PREFERRED EMBODIMENT

Figure 1:
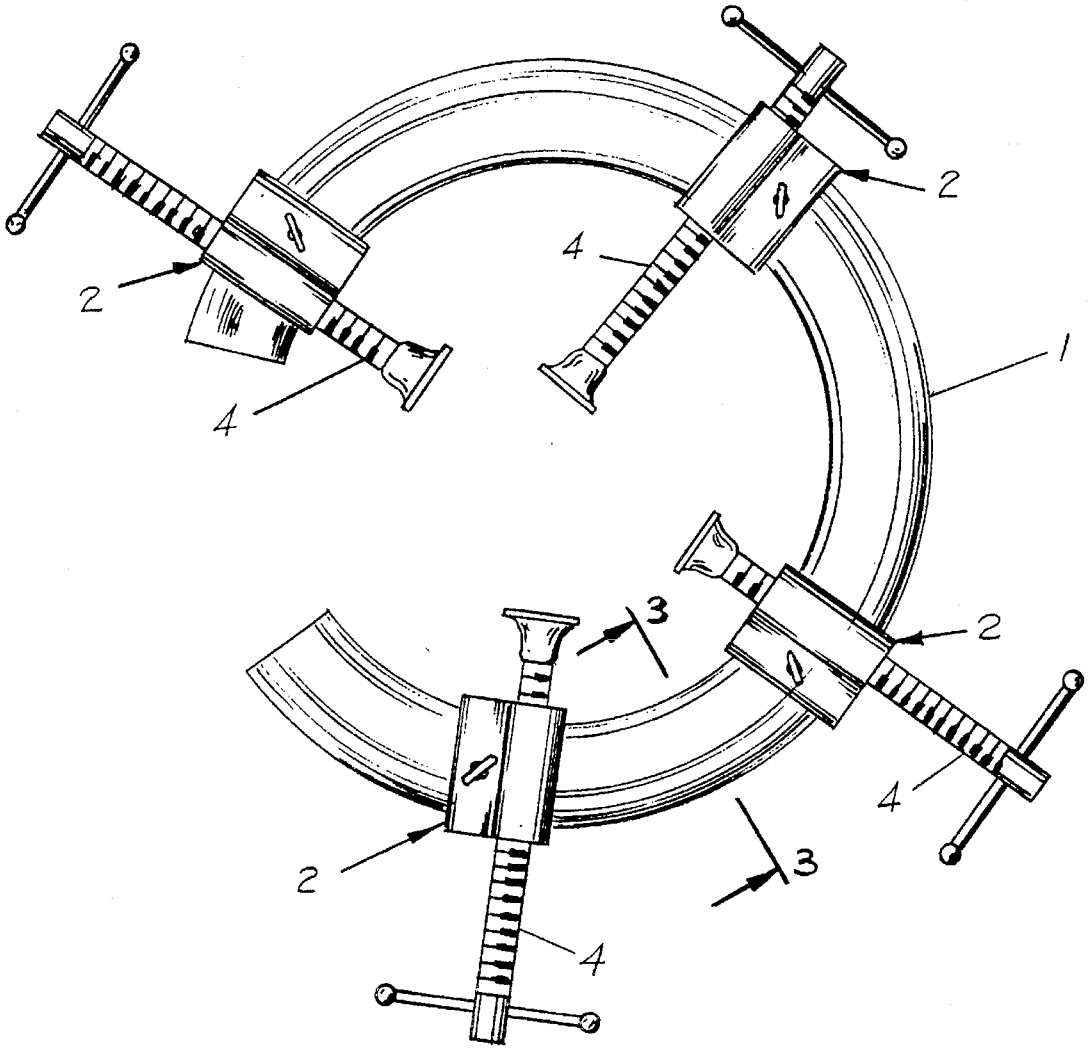
FIG. 1 is a perspective view of a circle clamp constructed in accordance with the present invention as a frame with four clamping units on it.
Figure 2:
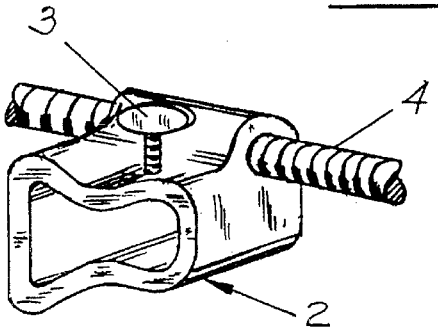
FIG. 2 is a perspective view of a clamping unit of the circle clamp.
Figure 3:
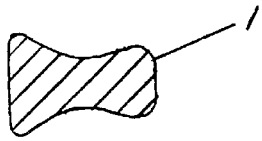
FIG. 3 is cross-sectional view of the frame.

The clamping unit, FIG. 2, consists of a clamp screw 4, a small thumbscrew 3, and a base 2. The clamp screw 4 serves its normal purpose of adjustable force transmission, the thumbscrew 3 holds the base 2 in the desired place on the frame 1, and the base 2 holds the clamp screw 4, fits over the frame 1, and transmits the force from the clamp screw 4 to the frame 1.

The frame 1 counteracts all holding forces between the clamping units that are in use. The frame L is circular, i.e., has a constant radius of curvature about its entire circumference, and had a non-circular cross-sectional shape that allows the base 2 to be slid along the frame 1, but prevents rotation of the base out of the plane of the frame. In the preferred embodiment, the cross-section is similar to that of a common C-clamp, but with less radical changes in the frame thickness along the axis of symmetry. The frame 1 presented here is not a full circle of 360 degrees but extends through an arc of about 315 degrees so as to present a gap of about 45 degrees to accommodate the addition or removal of other clamping units in this embodiment, to allow the whole clamp frame 1 to be slipped over an otherwise inaccessible work piece, and to allow the nesting of more than one circle clamp to apply three-dimensional pressure directed at one common center point in a case where frame diameters are nearly equal. The ends of this frame 1 are slightly flared out in thickness so as to prevent the clamping units from accidentally falling off while allowing them to be easily moved when changing the position of the unit on the frame. Although any stiff material could be made to work, it is preferred that the screws are steel from standard parts and the frame and bases are precision cast ductile iron.

What is claimed is:

1. A clamp comprising:

(A) a rigid frame which is at least semi-circular in shape and which has a constant radius of curvature about an entire circumference thereof so as to present a center point within said frame; and (B) a plurality of clamping units which are adjustably mounted on said frame, each of said clamping units including (1) a base which is mounted on said frame for movement therealong and which is incapable of rotational movement with respect to said frame, and (2) a clamp screw which is mounted on said base and which always projects towards said center point regardless of the location of said base on said frame.

2. A clamp as defined in claim 1, wherein said frame is semi-circular and presents a gap which is dimensioned and configured 1) to accommodate addition and removal of said clamping units from said frame and 2) to permit said clamp to be slipped over an otherwise inaccessible work piece.

3. A clamp as defined in claim 1, wherein said frame has two ends which are slightly flared in thickness so as to prevent clamping units from accidentally falling off said frame.

4. A clamp as defined in claim 2, wherein said frame extends through an arc of about 315°, and wherein said gap extends through an arc of about 45°.

5. A clamp as defined in claim 1, wherein said base and said frame have non-circular, mating cross-sections.

6. A clamp as defined in claim 4, wherein each of said clamping units further comprises a coupling device which is adjustably mounted on said base thereof and which selectively holds said base to said frame thereby to prevent movement of said clamping unit relative to said frame.

7. A clamp as defined in claim 9, wherein said coupling device comprises a thumbscrew which is threadedly mounted on said base.

8. A clamp comprising:

(A) a rigid frame which is semi-circular in shape and which has a constant radius of curvature about an entire circumference thereof so as to present a center point within said frame, wherein said frame extends through an arc of about 315° thereby to present a gap of about 45°, and wherein said frame has a non-circular cross-section; and (B) a plurality of clamping units which lie in a common plane and which are adjustably mounted on said frame, each of said clamping units including (1) a base which is mounted on said frame for movement therealong and which has a non-circular cross-section which matches that of said frame, whereby said base is incapable of rotational movement with respect to said frame, (2) a clamp screw which is threadedly mounted on said base and which always projects towards said center point regardless of the location of said base on said frame, and (3) a thumbscrew which is threadedly mounted on said base and which selectively holds said base to said frame thereby to prevent movement of said clamping unit relative to said frame.

9. A clamp as defined in claim 7, wherein said gap is dimensioned and configured to 1) accommodate addition and removal of said clamping units from said frame and 2) permit said clamp to be slipped over an otherwise inaccessible work piece.

10. A clamp as defined in claim 8, wherein said frame has two ends which are slightly flared in thickness so as to prevent clamping units from accidentally falling off said frame.

* * * * *